US006637397B2

(12) United States Patent
Ward et al.

(10) Patent No.: US 6,637,397 B2
(45) Date of Patent: Oct. 28, 2003

(54) INTAKE MANIFOLD FOR AN ENGINE

(75) Inventors: Lyle Ward, Royal Oak, MI (US); Kevin Beach, St. Clair Shores, MI (US); Mike Ruthenberg, Columbus, MI (US); Michael Jones, Troy, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 09/950,221

(22) Filed: Sep. 7, 2001

(65) Prior Publication Data

US 2002/0083911 A1 Jul. 4, 2002

Related U.S. Application Data

(60) Provisional application No. 60/230,960, filed on Sep. 7, 2000.

(51) Int. Cl.[7] ..... F02M 35/10

(52) U.S. Cl. ..... 123/184.55

(58) Field of Search ..... 123/184.55, 184.34, 123/184.35, 184.36, 184.45, 184.48, 184.49, 184.53

(56) References Cited

U.S. PATENT DOCUMENTS

| | | | | |
|---|---|---|---|---|
| 1,941,334 A | | 12/1933 | Aseltine | |
| 1,966,329 A | | 7/1934 | Aseltine | |
| 3,282,261 A | | 11/1966 | Bartholomew | |
| 4,253,432 A | | 3/1981 | Nohira et al. | |
| 4,254,747 A | | 3/1981 | Sumiyoshi et al. | |
| 4,256,063 A | | 3/1981 | Sumiyoshi et al. | |
| 4,262,639 A | | 4/1981 | Motosugi et al. | |
| 4,308,837 A | | 1/1982 | Nohira et al. | |
| 4,349,005 A | | 9/1982 | Gotoh et al. | |
| 4,423,709 A | | 1/1984 | Arrieta | |
| 4,502,444 A | | 3/1985 | Rubbo et al. | |
| 4,553,507 A | | 11/1985 | Shaffer | |
| 4,579,096 A | | 4/1986 | Kobayashi et al. | |
| 4,612,903 A | * | 9/1986 | Urabe et al. | 123/432 |
| 4,643,138 A | * | 2/1987 | Ruf et al. | 123/184.34 |
| 4,803,961 A | | 2/1989 | Hiraoka et al. | |
| 4,930,468 A | | 6/1990 | Stockhausen | |
| 4,945,865 A | | 8/1990 | Lee | |
| 5,000,129 A | | 3/1991 | Fukada et al. | |
| 5,005,533 A | | 4/1991 | Suzuki et al. | |
| 5,056,473 A | | 10/1991 | Asaki et al. | |
| 5,069,175 A | | 12/1991 | Simko | |
| 5,133,308 A | * | 7/1992 | Hitomi et al. | 123/184.31 |
| 5,211,139 A | | 5/1993 | Houle et al. | |
| 5,492,088 A | * | 2/1996 | Ohrnberger | 123/184.34 |
| 5,590,628 A | | 1/1997 | Patyi et al. | |
| 5,632,239 A | | 5/1997 | Patyi et al. | |
| 5,813,380 A | | 9/1998 | Takahashi et al. | |
| 5,992,370 A | | 11/1999 | Pringle et al. | |
| 6,016,780 A | * | 1/2000 | Fischer | 123/184.26 |
| 6,260,528 B1 | | 7/2001 | Pringle et al. | |

FOREIGN PATENT DOCUMENTS

| | | |
|---|---|---|
| DE | 19614474 A1 | 10/1997 |
| WO | WO 96/31692 | 10/1996 |

OTHER PUBLICATIONS

European Patent Office, *Patent Abstracts of Japan*, Publication No. 05033679, Publication Date: Sep. 2, 1993—Application No. 03192122, Application Date: Jul. 31, 1991, 1 page.

European Patent Office, *Patent Abstracts of Japan*, Publication No. 02256837, Publication date: Oct. 17, 1990—Application No. 01012182, Application Date: Jan. 21, 1989, 1 page.

* cited by examiner

*Primary Examiner*—Henry C. Yuen
*Assistant Examiner*—Hyder Ali
(74) *Attorney, Agent, or Firm*—Warn, Burgess & Hoffmann, P.C.; Greg Dziegielewski

(57) ABSTRACT

The present invention relates to a modified intake manifold having short runner valves in the manifold tuning valve. Anti-chatter devices are disclosed for reducing shaft chatter without placing friction on the shafts. A lost motion linkage is used to ensure closure of the short runner valves. Radiused seating surfaces are used for seating of the manifold tuning valve.

9 Claims, 9 Drawing Sheets

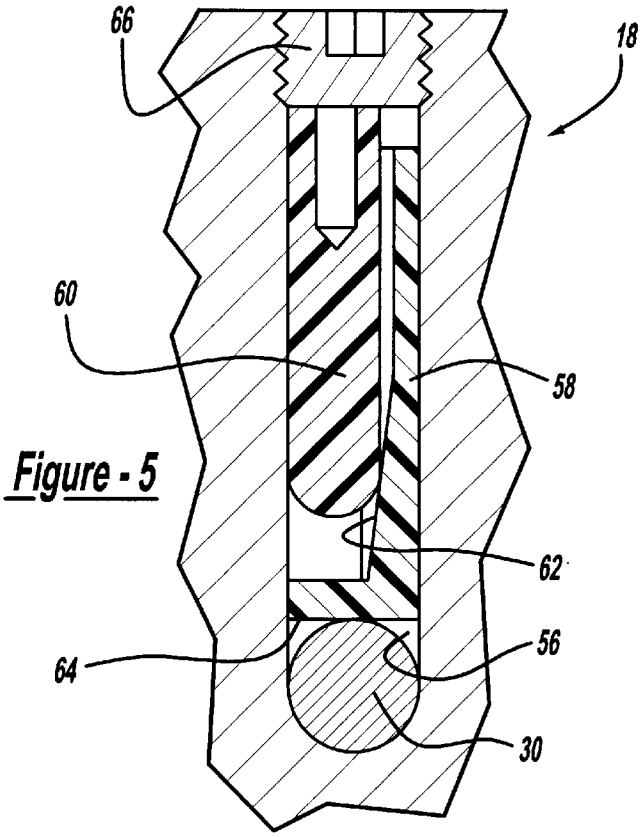
Figure - 5
Figure - 5a
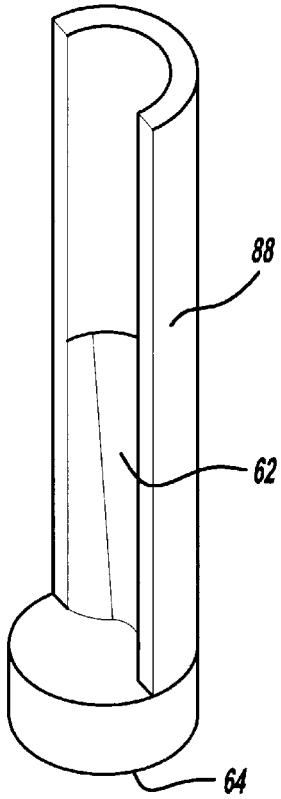
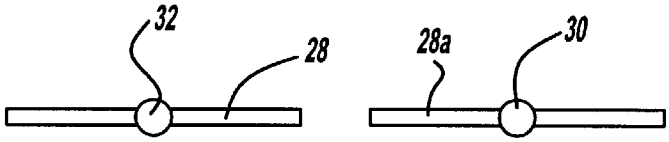
Figure - 6a
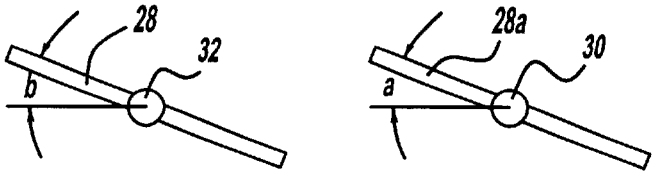
Figure - 6b
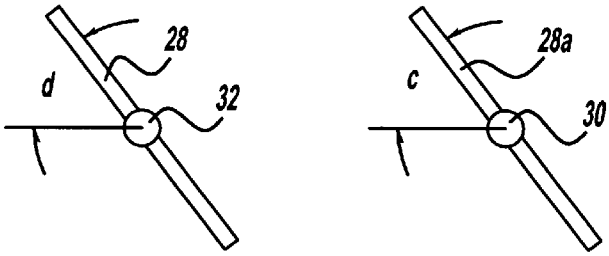
Figure - 6c

INTAKE MANIFOLD FOR AN ENGINE

TECHNICAL FIELD

The present invention relates generally to intake manifolds for an internal combustion engine. More particularly, the present invention relates to an improved multi-plenum air distribution manifold with improvements in short runner valve assemblies, manifold tuning valves and shaft quieting mechanisms.

BACKGROUND OF THE INVENTION

Intake manifolds including short runner valves and manifold tuning valves are known for use in modern fuel injected engines. These systems have provided improvements in performance for today's engines. Present designs, while generally suitable, still have many areas where improvements in both manufacturing and operation are desirable. Some of the current problems in need of solutions are set forth below.

Because the performance of the engine is directly related to the quickness and efficiency of opening and closing short runner and manifold tuning valves, it is desirable to have the valves operate as friction free as possible. One of the greatest friction areas is along the actuating shafts of the short runner valves. Certainly, using relatively ample clearance in the fittings for these shafts allows low friction operation. However, these clearances also may produce chatter if left unchecked. U.S. Pat. No. 5,992,370 teaches biasing of the shafts for reducing shaft "chatter". Such biasing assemblies are very effective in reducing noise. However, shaft biasing does increase friction, somewhat reducing response time. Therefore, it is desirable to provide a lower friction anti-chatter device.

A second area needing to be addressed is the problem of sticking or binding valve plates. Of course, it is desirable to have valve plates which completely seal off the short runner passages. However, if the plates are not set up properly, they may bind. This is typically due to the thermal expansion of the various parts during warm-up of the engine. There is a need to provide valve plates which prevent binding during thermal expansion of the manifold. Additionally, proper synchronized closure of groups of valves connected on separate shafts is problematic. If for some reason, the plates are not mounted properly, full closure is not realized.

Additionally, there remains a need in the art for providing an improved method for creating an effective sealing arrangement for a manifold tuning valve.

SUMMARY OF THE INVENTION

Thus, in accordance with the present invention there is an intake manifold for a vehicle which has improved operational characteristics. The intake manifold includes an intake housing having a plurality of short runner valves for metering air intake. The short runner valves are attached to at least a pair of shafts, opening the valves substantially in unison. A linkage connects the shafts for a synchronized movement therebetween. The linkage includes a lost motion device such that one set of the valves continues to be closed after a valve attached to one of the shafts has reached a closed position. Additionally, a manifold tuning valve configuration is provided which has a radiused surface for engagement of the tuning valve plate and sealing of the manifold chambers. Additionally, an anti-chatter device may be placed in an opening adjacent the shafts holding the short runner valves.

The anti-chatter device of the present invention removes any play of the shaft to the bore without imparting biasing on the shaft.

A further understanding of the present invention will be had in view of the description of the drawings and detailed description of the invention, when viewed in conjunction with the subjoined claims.

BRIEF DESCRIPTION OF THE DRAWINGS

FIG. 5 is a sectional view of the short runner shaft anti-chatter device taken along line 5—5 of FIG. 4;

FIG. 5*a* is a perspective view of the camming member of the anti-chatter device of FIG. 5;

FIGS. 6*a* through 6*f* show a representative opening and closing sequence of the of short runner valve of the present invention;

DETAILED DESCRIPTION OF THE PREFERRED EMBODIMENTS

In accordance with the present invention, there is provided a manifold generally shown at 10 for a vehicle engine, not shown but known to those skilled in the art. Manifold 10 is for a six cylinder engine but it will be readily appreciated that the concepts discussed herein will be useful in other engine designs.

Manifold 10 includes novel improvements in the short runner valve linkage, generally indicated at 12. The short runner valve shaft assemblies are generally indicated at 14, the manifold tuning valve assembly is generally indicated at 16, and the short runner valve quieting mechanism is generally indicated at 18.

Figure 1:
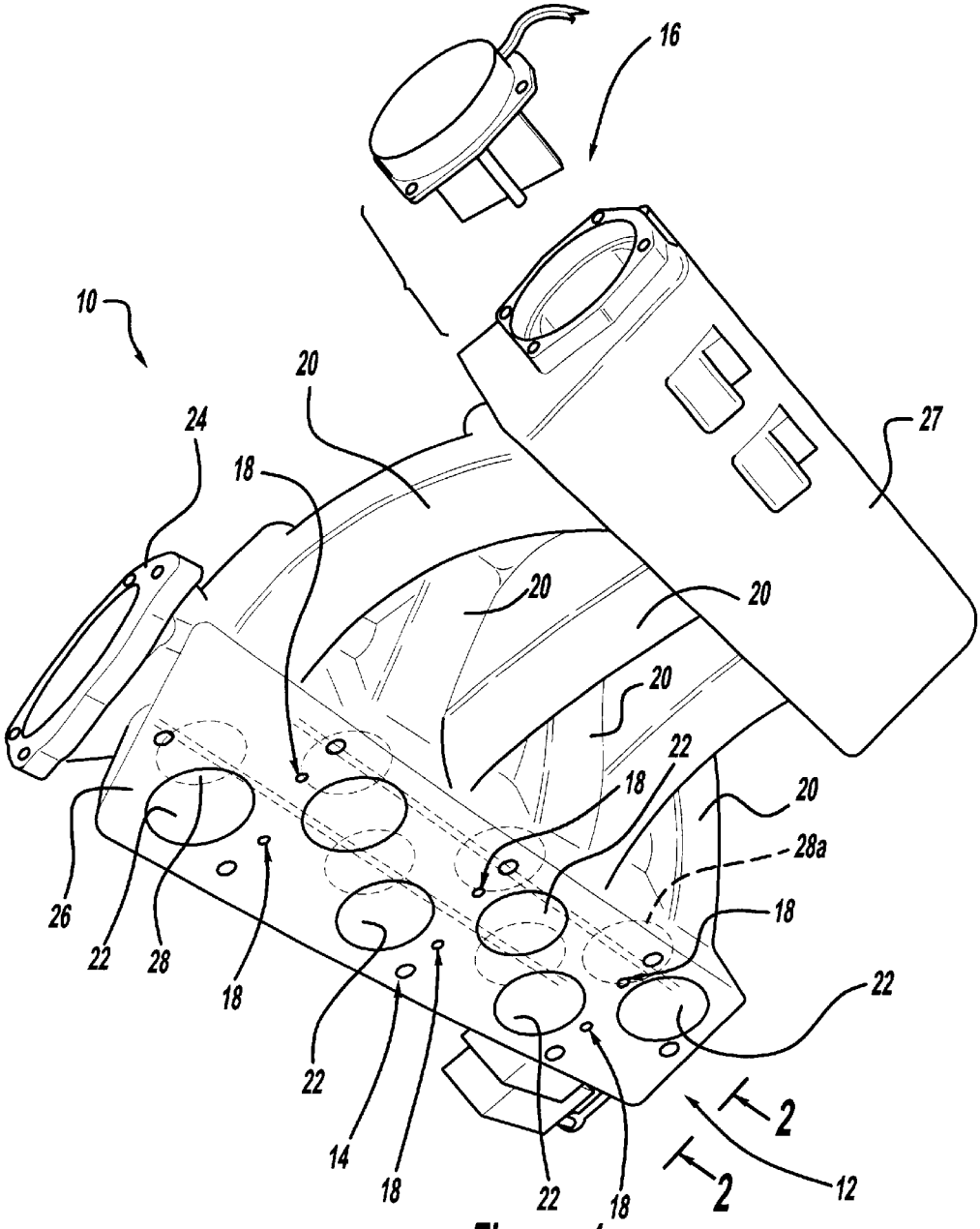
FIG. 1 is an exploded perspective view of a manifold made in accordance with the teachings of the present invention.

Thus, referring now to FIG. 1, a manifold 10 includes long runners generally indicated by numeral 20, and short runners indicated at 22. The manifold has a flange 24 for attaching of the throttle body, and an engine side flange 26 which attaches the manifold to the engine. The mixing plenum 27 is provided for mixing of the intake stream, as is known in the art. For instance, reference may be made to U.S. Pat. No. 5,992,370, the teachings of which are incorporated herein by reference, for the various purposes of short runner valves and manifold tuning valves used in such manifolds therein.

Figure 4:
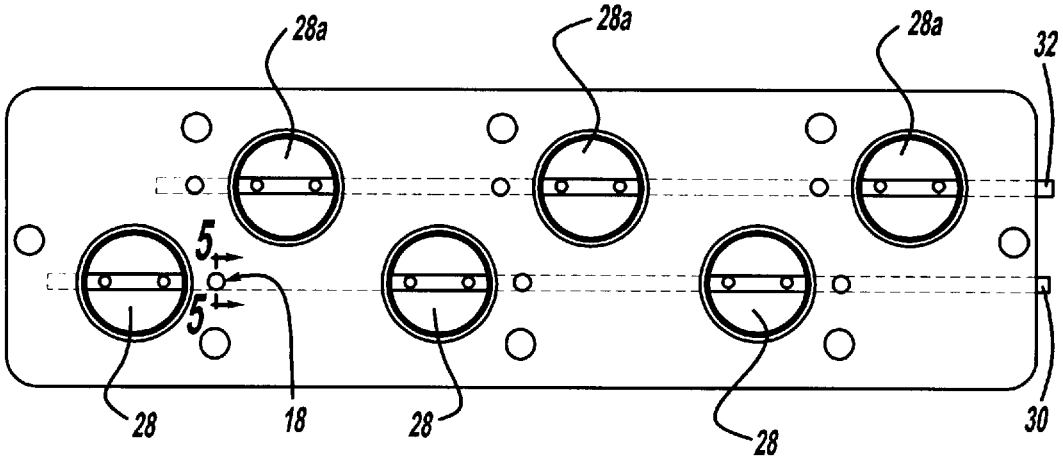
FIG. 4 is a plan view of the short runner assembly of FIG. 1.

Referring now to FIG. 4, the short runner valve plates 28 are situated on separate valve shafts 30 and 32. In order for the short runner valve mechanism to operate correctly, a synchronous motion and particularly closing of the valve plates 28 between the shafts 30 and 32 is desirable. Typically, when the valves are fully opened, the finite control or variation in pitch of the valve plates 28 between the shafts 30 and 32 is of relatively little concern. However, when it is necessary for the valves to be closed fully, the tolerances of having one shaft farther opened than the other must be minimal. In the open position, the angle of the valve plate in the opening may vary anywhere from 0 degrees up to about 10 degrees from vertical, depending on shaft and plate diameter. However, it is desirable for the valve plates to fully close when desired. While manufacturing procedures for such devices are sophisticated and relatively good, invariably one of the shafts will tend to close the valves in a particular set of short runner valves before the other set of short runner valves on the second shaft will close. Because the linkages are typically tied together for synchronous actuation of the sets of valves, this leaves a partially open condition on the other set of valves in some of the prior art devices.

Figure 2:
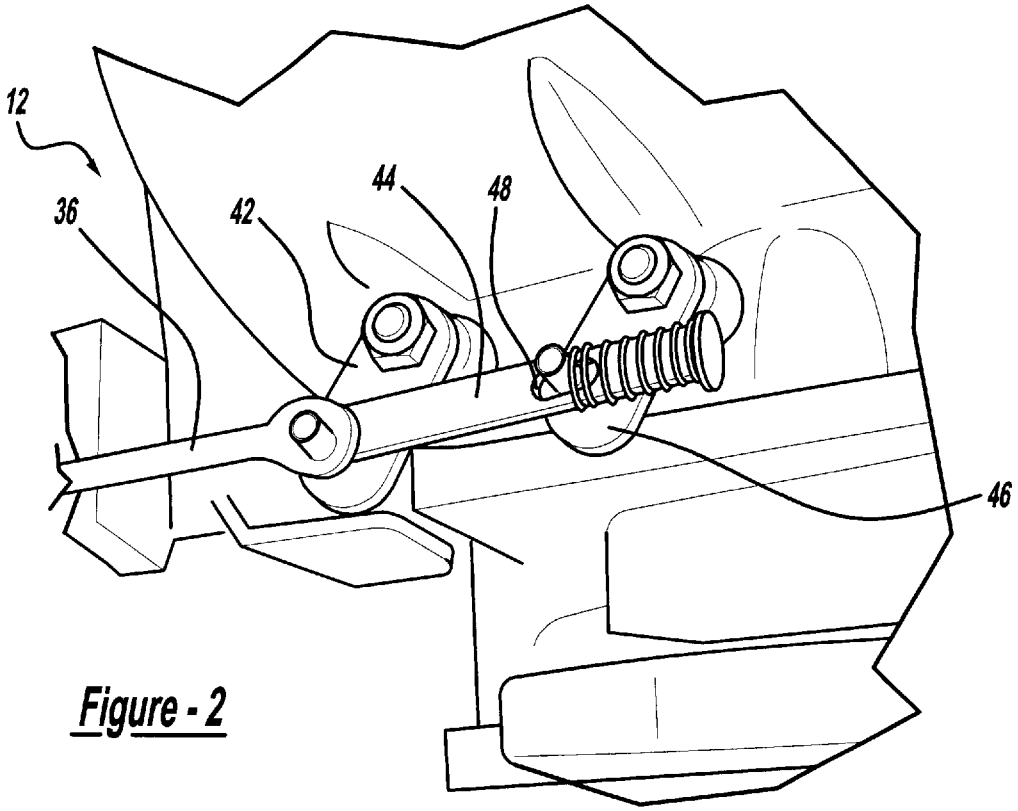
FIG. 2 is a detailed perspective of the short runner valve system taken in direction 2—2 of FIG. 1.
Figure 3:
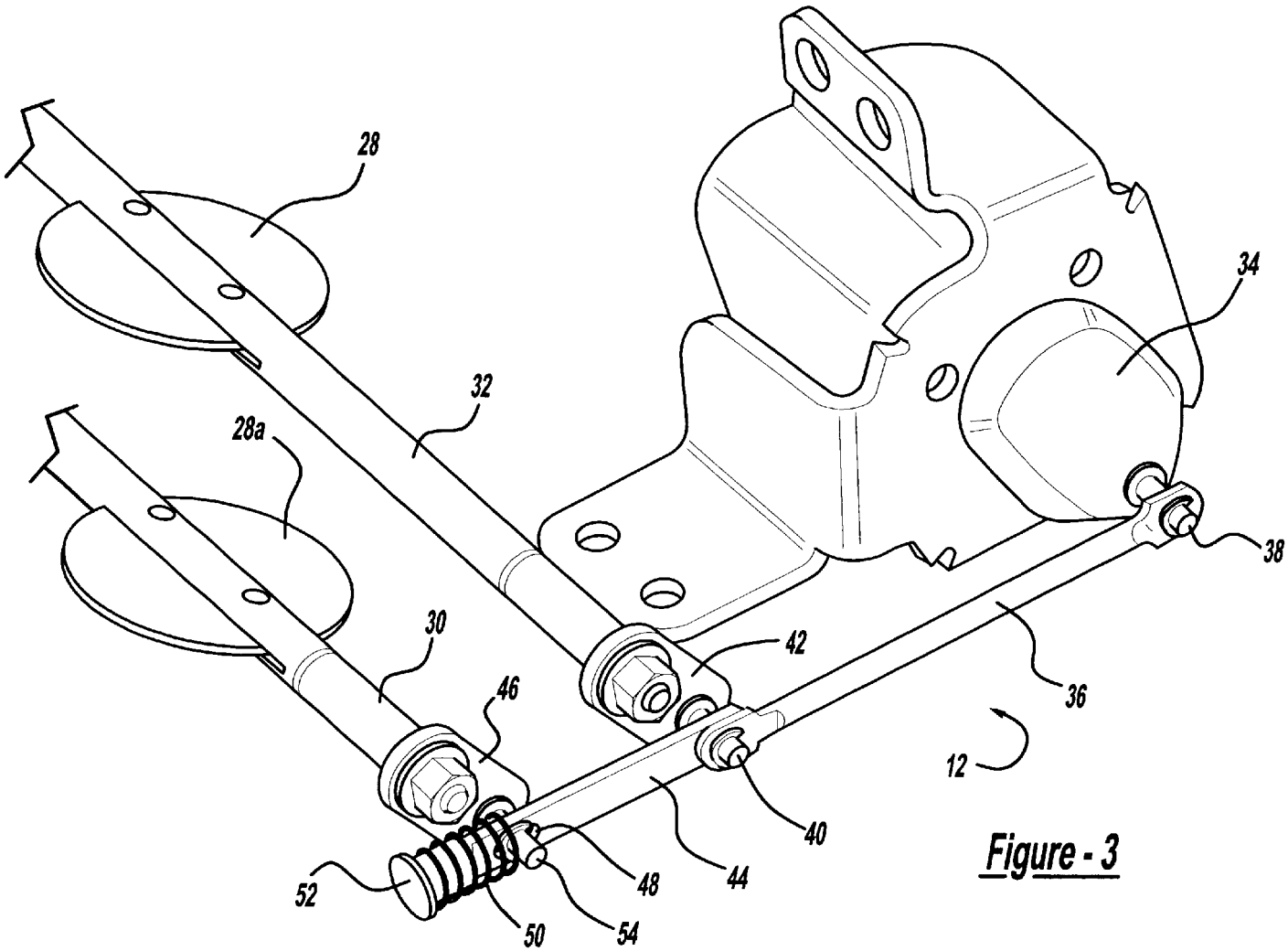
FIG. 3 is a broken away perspective view of the linkage and short runner valve assembly.
Figure 6D:
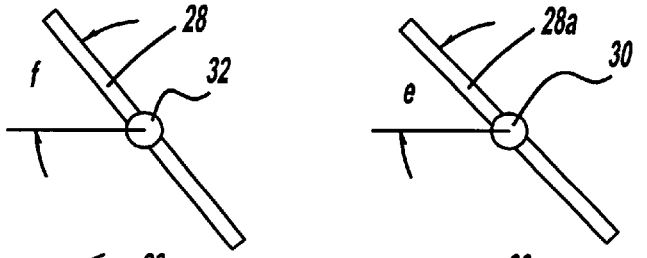
Figure 6E:
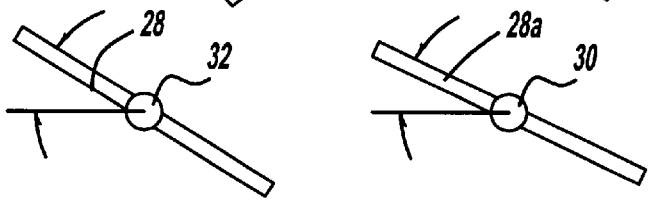
Figure 6F:
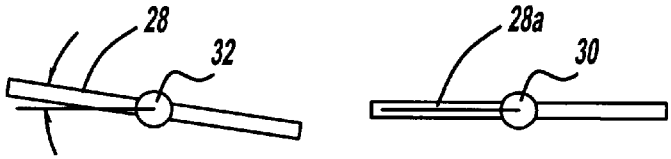

Referring now to FIGS. 2 and 3, a linkage mechanism is set forth therein at 12 for allowing the valves to be actuated to a fully closed position. Mechanism 12 includes an actuation motor 34, which actuates a control shaft 36. The control shaft 36 is coupled to an actuation pin 38 on the actuation motor side, and a pin 40 on the valve shaft control arm 42. The valve shaft control arm 42 is coupled for rotating the shaft 32. A second rod link 44 is coupled to the pin 40 for directing movement to a second valve shaft control arm 46. The control arm 44 includes a slot therein 48 for providing lost motion at the end of the stroke, to allow closing of the valve plates 28*a* on the shaft 32, and thereafter closing of the valve plates on shaft 30. The lost motion device includes slot 48, a spring member 50 and an end cap portion 52. Pin 54 is attached to arm 46, and engages the slot 48. Referring to FIGS. 6*a* through 6*f*, there is shown a typical closing and opening of the valve plate assembly. Upon opening of the valve plate assembly, the slot has already reached it's over travel position. Therefore, upon opening, the plate 28, which is hard connected by rod 36 to actuator 34, begins to open first, with the plate 28*a* following shortly thereafter. There is a difference in degree of opening between angle A and angle B of approximately 2½ to 5 degrees. This angle also carries on in angle C and angle D. Thus, in the wide open position, the plate 28*a* is slightly biased toward a more closed position, that the plate 28. Referring to FIGS. 6*b* and 6*e*, the plate 28*a* begins closing before plate 28, with a 5 degree difference in angle between angles E and F. This same 5 degree difference is apparent in angles G and H, and as set forth in FIG. 6*f*, when plate 28*a* is closed completely, plate 28 is still open at an angle of about 5 degrees, angle 1. Thereafter, the lost motion device rides along the slot, further allowing plate 28 to become fully closed.

Referring now to FIGS. 7*a* through 7*d*, there is shown alternate embodiments of short runner valve actuation linkages 12. Linkage 112 in FIG. 6*f* includes a springed actuation arm 114, which allows for lost motion when the valve 28*a* is closed first, allowing the valve 28 to close thereafter by continuing motion through the actuator 116 of the shaft mechanism, and allowing the linkage 118 to stretch or have lost motion such that the other set of valve plates can be closed.

Figure 7A:
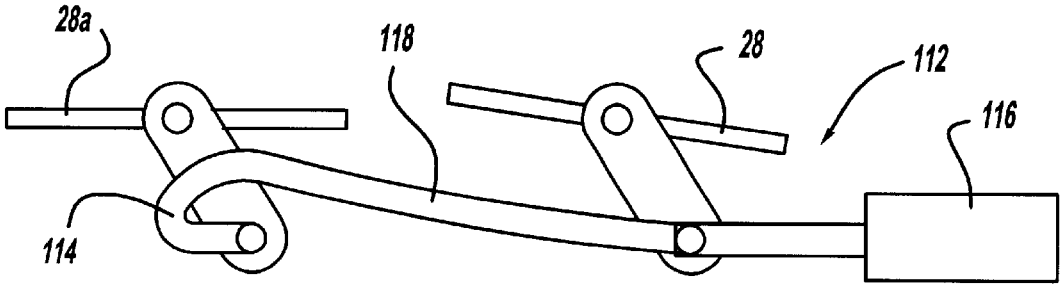
FIGS. 7*a* through 7*d* are alternate embodiments of the valve shaft actuator assembly of the present invention.
Figure 7B:
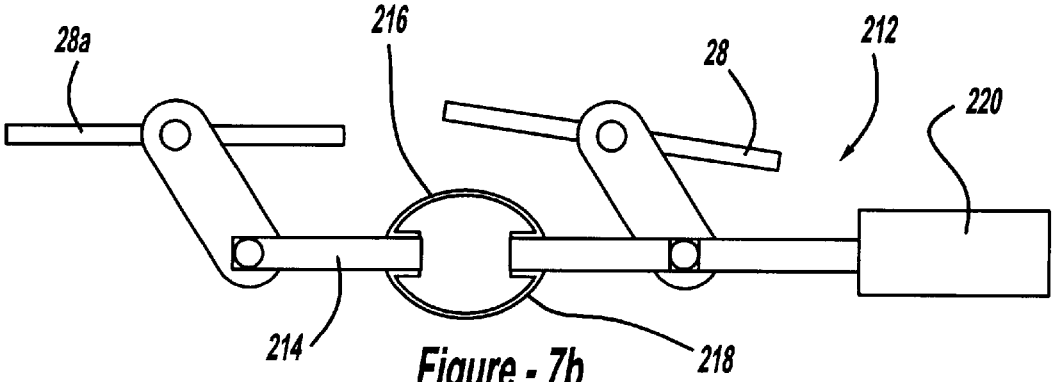

FIG. 7*b* shows an actuation assembly 212, which includes a lost motion arm 214, which has a pair of spring members 216 and 218. Upon actuation of the motor 220 the arms close valve 28*a* first, and thereafter, the springs 216 and 218 allow lost motion to allow closing of the valve 28.

Figure 7C:
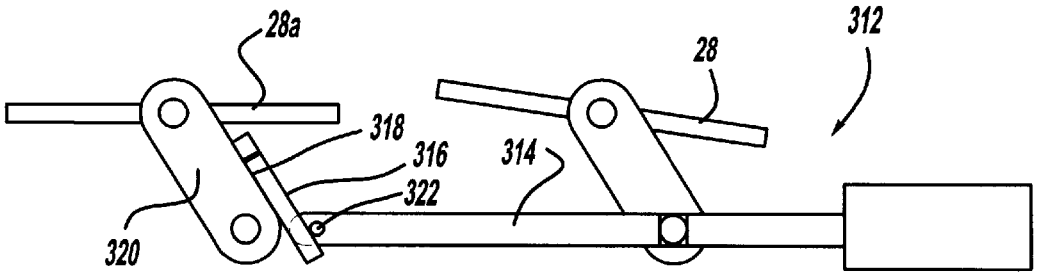
Figure 7D:
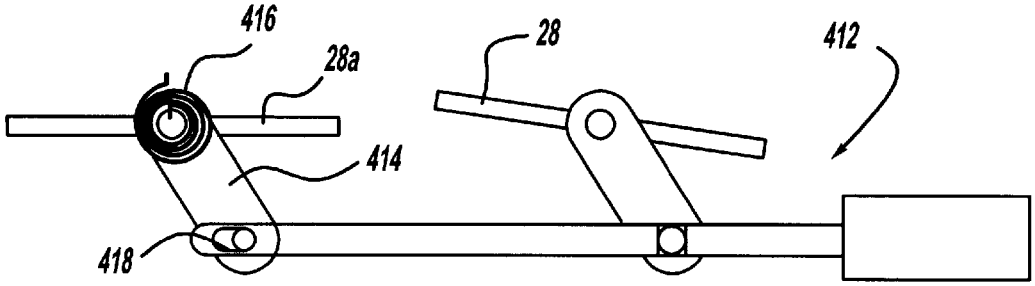

Referring to FIG. 7*c*, there is shown a still further alternate embodiment of the linkage 312. Linkage 312 includes a second lost motion arm 314. The arm 314 is attached to a spring member 316, which is coupled at a first end 318 to the valve arm 320. At the second end, the spring member 314 is coupled at 322 to the shaft 314. Thus, as the member 28*a* closes, the spring member 316 separates from engagement with the lever 320, providing lost motion such that the valve 28 can be fully closed. Member 412 provides a spring tensioned arm 414, by way of the clock spring 416. This mechanism is similar to the original mechanism, in that the slot 418 provides lost motion.

Referring now to FIG. 5, there is shown a mechanism for reducing noise in the short runner valve assembly. As set forth previously, it is necessary to have clearances between the valve shaft 30 and the bore in the manifold 56. This provides for suitable low friction operation of the valve plate members, thus increasing performance of the engine and responsiveness. The anti-chatter mechanism 18 holds the shaft 30 into the bore 56 to prevent it from chattering. In the first embodiment, the mechanism includes a camming stop member 58 and a wedge member 60. The camming stop member 58 is made of a low friction material such as molybdenum disulfide filled nylon. It includes a camming ramp 62 and a shaft engagement surface 64. As will be readily appreciated by those skilled in the art, the camming member 58 may be placed in the bore 56 and pushed in at a pressure which is predetermined to hold the shaft 30 in place. Thereafter, the wedge member 60 may be inserted into the shaft and lodged against the ramp surface 62 for securing the camming member 58 in place. Thus, due to the ramp's surface, the camming member 58 is pushed toward the edge of the bore 56 with much more force than may be placed in a downward direction toward the shaft 30. This allows the anti-chatter mechanism to be held in place without any biasing or very little biasing against the shaft 30 which might increase friction and reduce performance of the short runner valve assembly. Once the camming member 58 is in place and the wedge member 60 is also in place, a cap 66 may be lodged in the bore for securing the mechanism. It will be readily appreciated that other caps can also be utilized in the present invention.

Figure 10:
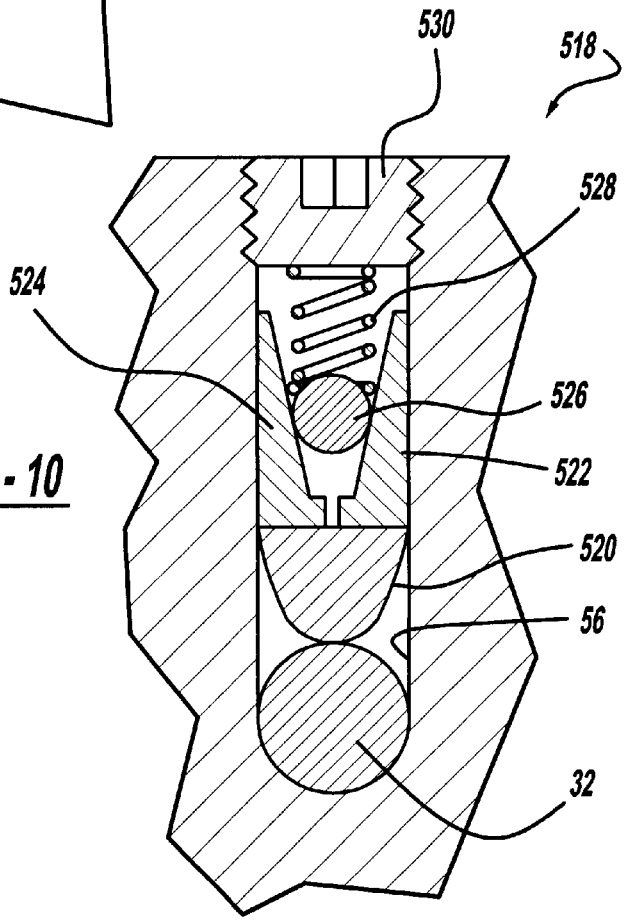
FIG. 10 is an alternate embodiment of a shaft quieting assembly of the present invention.
Figure 10A:
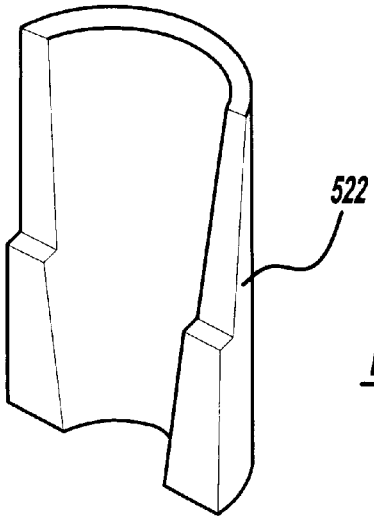
FIG. 10*a* is a perspective view of a camming member portion of FIG. 10.
Figure 11:
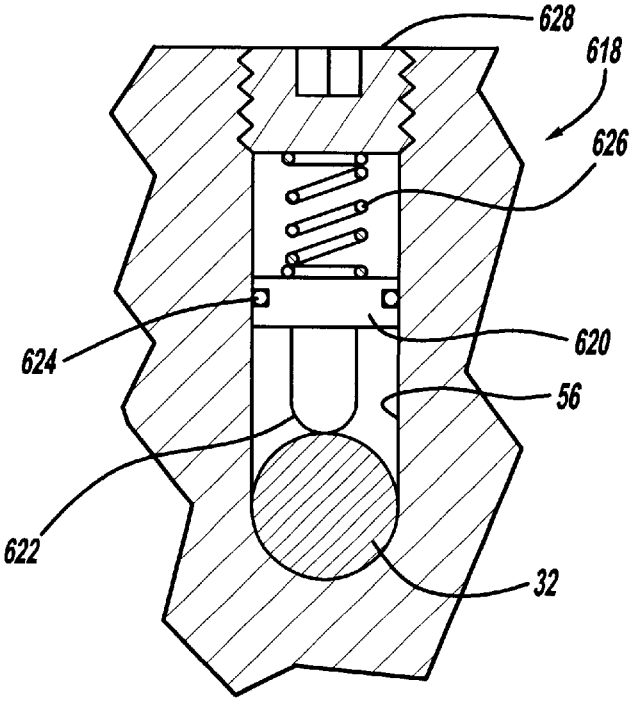
FIGS. 11 and 12 are alternate embodiments of shaft quieting assemblies of the present invention.
Figure 12:
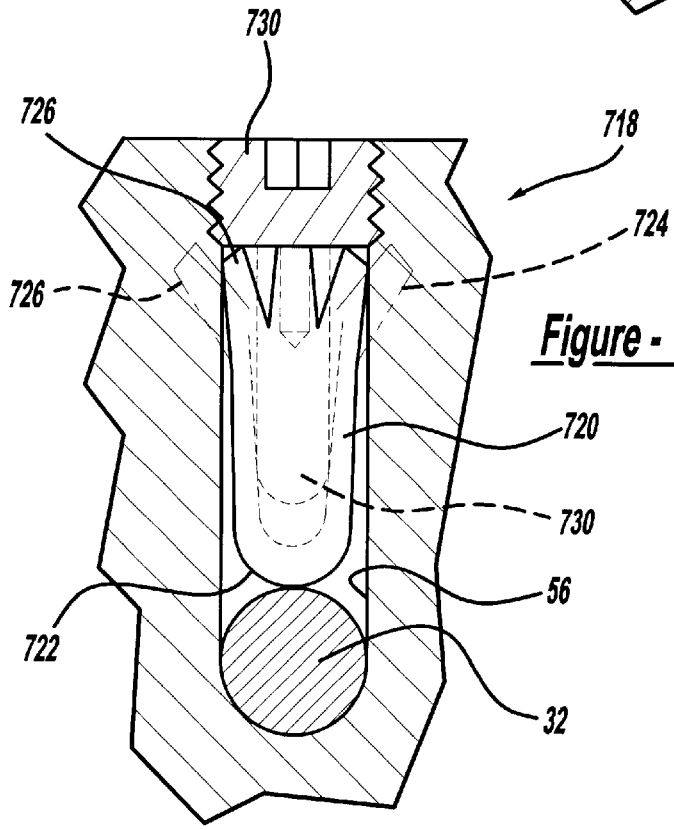

Referring now to FIGS. 10, 11 and 12, there are shown alternate embodiments of an anti-chatter device 518, 618 and 718. Thus, in accordance with the alternate embodiment, a shaft 32 is held in the cavity 56 by way of a shaft engaging member 520. The shaft engaging member 520 is held in contact with low frictional engagement of the shaft 32 by way of a pair of semi-circular cam members 522 and 524. A ball member 526 provides the necessary outward force for camming of the members 522 and 524 toward the walls of opening 56. A spring member 528 holds the camming member in place and prevents the ball from dislodging from detachment. Cap 530 secures the assembly in the bore 56. This prevents movement of the shaft without actually biasing any or very little on the shaft, since the ball forces members 522 and 524 in an outward direction rather than toward the shaft 32.

Referring now to FIG. 11, the assembly 618 includes a dash pot member 620, which has a shaft engaging portion 622 for holding the shaft 32 and preventing chatter. Dash pot member 620 may include an O-ring or other suitable frictional component 624 which contacts the walls of the opening 56. A spring member 626 is provided for urging the dash pot member 620 toward the shaft 32. However, any chattering of the shaft 32 is resisted by the frictional engagement of the side walls 56 of the dash pot member and the spring force. This spring provides a small force for biasing of the dash pot member onto the shaft 32, to ensure contact of the dash pot to the shaft. Cap 628 is used for securing the assembly in the bore.

Referring now to FIG. 12, member 718 is a further embodiment of the anti-chatter device of the present invention. The anti-chatter member 720 engages the shaft at an end 722 and frictionally secures itself in the shaft by way of leaves 720 for 726 and 728. The leaves are biased in a non-compacted arrangement toward being oversized of the bore 56, such that when they are placed under pressure into the bore 56, they are secured therein due to frictional engagement of the bore sides. Therefore, they resist any chattering movement of the shaft 32. Additionally, the cap 720 may be used to seal the assembly in place after the proper amount of pressure is placed on the member 720. A camming member 732 may be used if desired to secure the member 720.

Short runner valve assemblies have a tendency to expand and contract to a different rate than the manifold. Typically, the intake manifold 68 is made of an aluminum material, whereas the shafts 30 and 32 are a steel material, and still further, the valves and valve plates may be made of different materials. Thus, during a warm-up of the engine, the thermal expansion characteristics of these materials is greatly different. This, in some engines, causes binding of the valve plate assemblies. The plates 28 and 28*a* require relatively close tolerances for fitting within the bores. However, it is necessary to provide enough clearance to avoid the possible binding problem due to differing thermal expansion in the parts during warm-up thereof. It has been found that, therefore, it is necessary to provide a clearance C—C at the shaft location to avoid binding of these valves.

In a preferred embodiment of the present invention, these clearances are selected based on the geometry of the bore and valve plate components and thermal expansion characteristics of the manifold components. It will be readily appreciated that when the bore size is smaller, the clearance is smaller to provide for less comparative leakage, and as the plates get bigger, the clearance may be larger to have the same amount of less comparative leakage.

Figure 8:
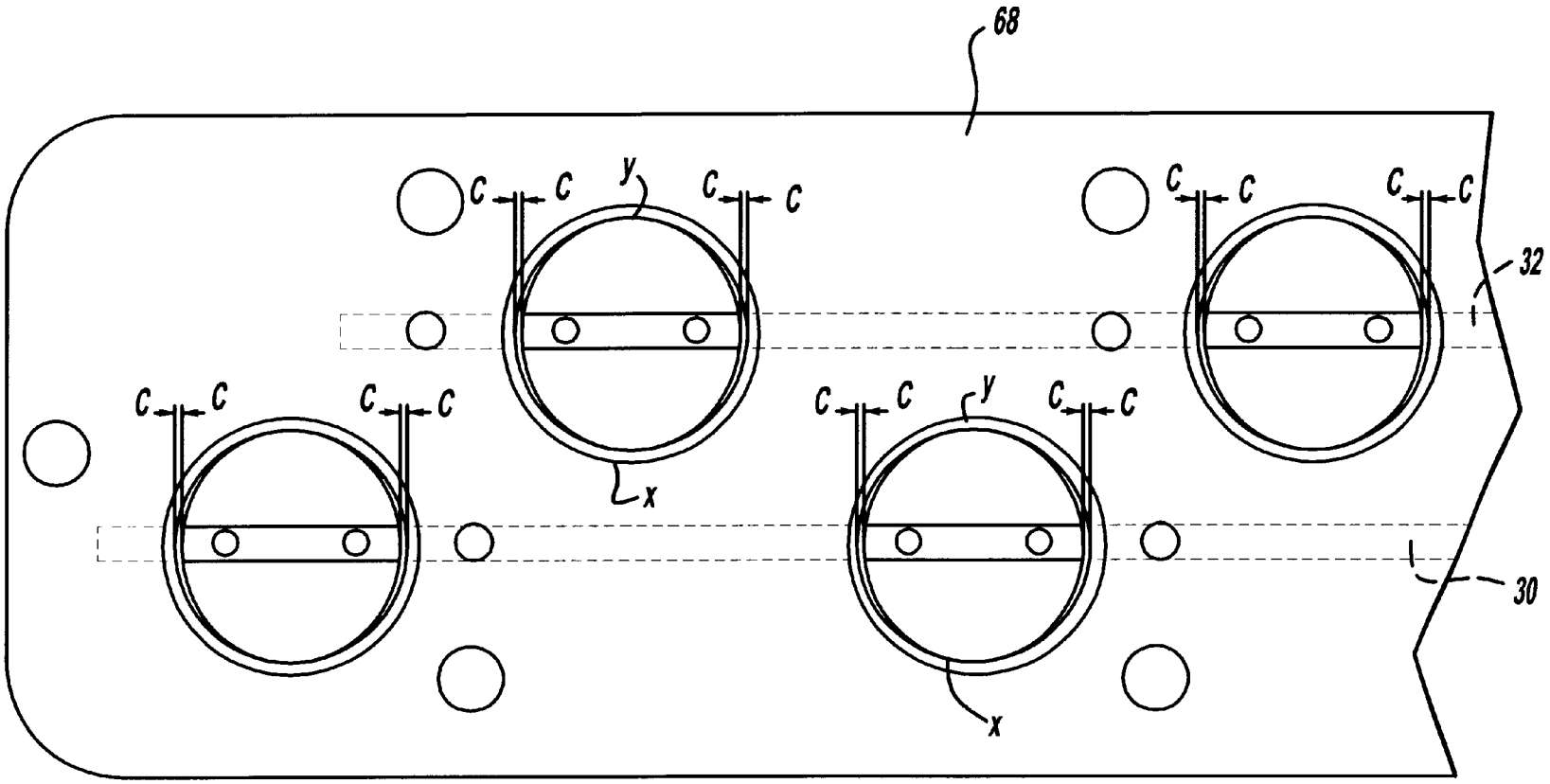
FIG. 8 is a detailed view showing the eccentricity of the short runner valves and resulting clearance on the valve shaft, as set forth in the present invention.

Referring now to FIG. 8, there is shown a valve plate assembly of the present invention. In the present invention, the valve plate 28 is a particular elliptical shape which is provided by way of stamping the plate at an angle such that it has parallel surfaces on the outside $\mathbf{28}_1$ and $\mathbf{28}_2$. Thus, while the plate is very thin, it forms an elliptical plate when viewed from the top, as shown in FIG. 8. While the ellipse is very minor, it does have the effect of allowing a wider clearance at the area C—C while there is a contact at points X and Y for closure of the short runner. This allows for the clearance C—C to be wider to prevent bonding due to thermal expansion of the shaft. Additionally, this allows the bore to be closed off in a more expedient manner, without risking binding of the plates in the bore. Thus, the shape of the actual plate is more like a section of a cylinder taken at an angle to provide the proper plate diameter of the present invention.

Figure 9A:
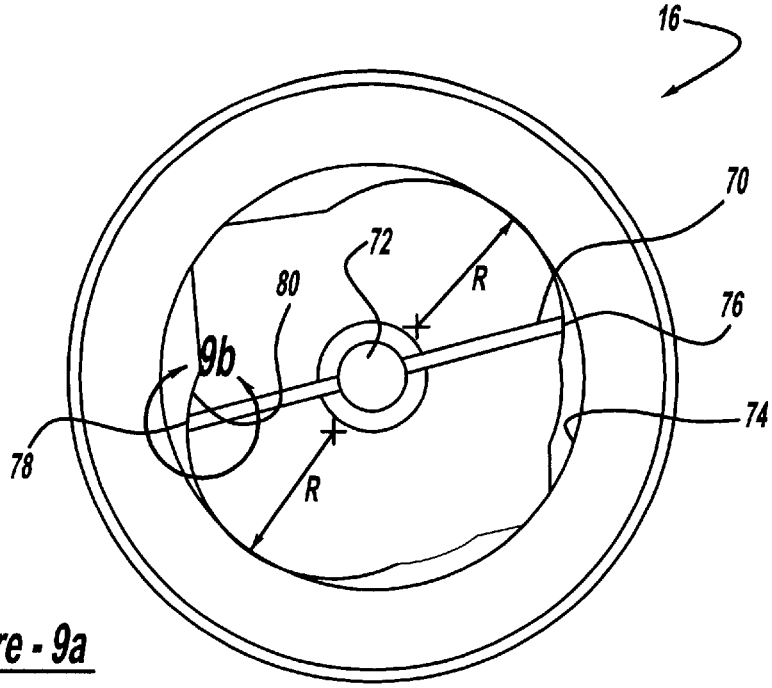
FIGS. 9*a* and 9*b* are detailed views showing the manifold tuning valve of the present invention.
Figure 9B:
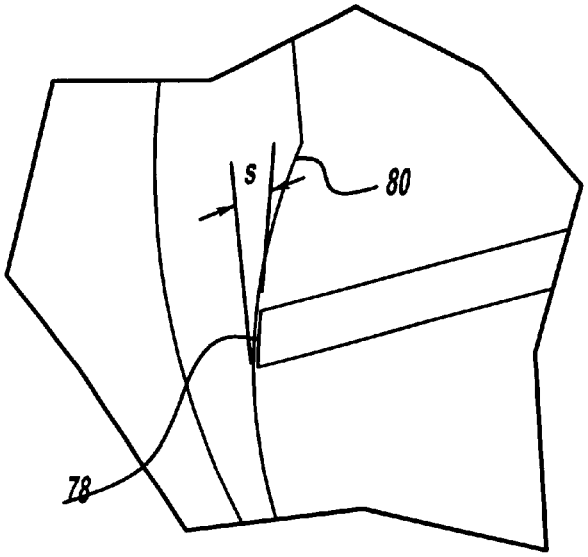

Referring now to FIGS. 9*a* and 9*b* there is shown a detailed view of the manifold tuning valve of the present invention. Typically, in manifold tuning valve assemblies it is necessary to have seating surfaces machined in the manifold design. This is because of the necessity of a close tolerance fit between seating surface on the manifold is desired to match with the butterfly of the tuning valve. Such machining operations increase the cost of a manifold substantially. In the present assembly there is provided a method and a manifold tuning valve receiving portion of the manifold which may be constructed easily by use of a round cutting tool as opposed to machining operations or the like.

In accordance with the present invention, there is provided a manifold tuning valve 16, as set forth above. Manifold tuning valve 16 includes a plate portion 70 which rotates about a central shaft portion 72. The manifold opening 74 is provided for insertion of the manifold valve assembly. As best seen in FIG. 9*b*, the angle of the surface 78 is from about 8 degrees to about 20 degrees, and preferably about a 20 degree angle. The manifold is cast such that an initial larger core portion 74 may be cut in for a cavity and, thereafter, an inner wall may be cut out to form the surfaces for engaging of the plates for sealing of the manifold tuning valve portion.

Thus, as shown in FIG. 9*b*, while a round cutter of radius R is used to cut the sealing surface 80, the surface has a circular cross section, as shown. The radius R is selected to be as large as it can be to fit into the opening 74. The larger the radius, the more the surface 80 acts as a flat surface for providing sealing contact with the surface 78 of the valve butterfly. This eliminates machining of the seating surface while providing good performance on the tuning valve.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. An intake manifold for a vehicle, comprising:

an intake housing having a plurality of short runner valves for metering air intake;

said short runner valves being attached to at least a pair of shafts for opening and closing said plurality of short runner valves substantially in unison; and a linkage connecting said shafts for synchronized movement therebetween;

said linkage including a lost motion device such that said valves continue to be closed after a valve attached to one of said shafts has reached a closed position, wherein said lost motion device comprises a biasable member operably connected with said linkage to provide continued travel of said valves.

2. The intake manifold of claim 1 wherein first one of said shafts includes a control arm and said control arm including a slot therein, a connection rod connected to a second one of said shafts, said shaft including a pin therein for operatively engaging said slot in said actuation arm, said slot and pin allowing for over travel in a first direction for allowing said one of said shafts to close said valves on said first one of said shafts and allowing the valves on said second one of said shafts to close thereafter.

3. The intake manifold of claim 2 wherein said lost motion device further includes a spring for biasing said pin toward a first direction in said slot.

4. The intake manifold of claim 1 wherein first and second control arms are attached to said shafts, said control arms connected to one another by way of a linkage synchronized movement therebetween said linkage including an integrated lost motion device allowing for differential movement between said first and second control arms, if required during closing of the valves.

5. The intake manifold of claim 4 wherein the lost motion device further comprises a resilient flexible shaft which is configured to allow movement.

6. An intake manifold for an engine comprising:

an intake plenum including a manifold tuning valve orifice for receiving a manifold tuning valve; and a manifold tuning valve operatively coupled with said orifice;

said tuning valve having a valve plate for selectively tuning the airflow into said orifice;

said valve plate including at least an outer peripheral sealing surface;

said orifice including seating surfaces formed thereon for engaging said outer peripheral sealing surface of said valve plate, wherein said seating surfaces have a radius offset from the pivot point of said valve plate.

7. The intake manifold of claim 6 wherein said valve plate has an engagement surface angled at from about 8 to about 20 degrees.

8. The intake manifold of claim 7 wherein said angle of said engagement surface is about 20 degrees.

9. The intake manifold of claim 6 wherein said radius is chosen to be as large as possible such that it effectively acts as a flat sealing surface.

* * * * *